US008359666B2

(12) United States Patent
Appel et al.

(10) Patent No.: US 8,359,666 B2
(45) Date of Patent: Jan. 29, 2013

(54) PATIENT GOWN AND METHOD OF ASSEMBLING ON A PATIENT

(75) Inventors: Bette Appel, Bloomfield Hills, MI (US); Judith L. Tappero-Norwick, Bloomfield Hills, MI (US)

(73) Assignee: Two Works LLC, Bloomfield Hills, MI (US)

( * ) Notice: Subject to any disclaimer, the term of this patent is extended or adjusted under 35 U.S.C. 154(b) by 250 days.

(21) Appl. No.: 12/732,730

(22) Filed: Mar. 26, 2010

(65) Prior Publication Data

US 2011/0231981 A1 Sep. 29, 2011

(51) Int. Cl.
*A41D 13/12* (2006.01)

(52) U.S. Cl. ..... 2/114

(58) Field of Classification Search ..... 2/114, 105, 2/106, 83, 74, 104, 115, 69, 75, 85, 70, 51, 2/48, 52; D2/720, 797, 798, 848
See application file for complete search history.

(56) References Cited

U.S. PATENT DOCUMENTS 646,194 A * 3/1900 Sims ..... 2/114
2,129,830 A * 9/1938 Durocher ..... 2/74
D119,368 S * 3/1940 Zuckerman ..... D2/786
2,549,494 A * 4/1951 Licht ..... 2/106
2,803,014 A * 8/1957 Beach ..... 2/105
2,919,567 A * 1/1960 Loeper ..... 66/173
3,141,175 A * 7/1964 Heater et al. ..... 2/74
D202,165 S * 9/1965 Hager ..... D2/821
3,877,078 A * 4/1975 Tepper ..... 2/74
4,570,268 A 2/1986 Freeman
4,686,715 A 8/1987 Price
4,837,863 A 6/1989 Van Scoy-Mosher
5,050,243 A * 9/1991 Udell ..... 2/114
5,088,117 A 2/1992 Fulmer
5,133,086 A 7/1992 Truitt et al.
5,228,141 A * 7/1993 Remsky et al. ..... 2/114
6,134,715 A 10/2000 McLennan
6,694,522 B1 2/2004 Neal
D547,927 S 8/2007 Booth
7,395,556 B2 * 7/2008 Eraca ..... 2/104
(Continued)

OTHER PUBLICATIONS

Sears, Neil, "Gown and out: 'Bottom-flashing' hospital robes to be replaced by more modest attire," MailOnline, http://www.dailymail.co.uk/health/article-1209743/Bottom-flashing-hospital-gowns-replaced-modest-attire.html, 3 pgs, Aug. 31, 2009.
Lagnado, Lucette, "The Hospital Gown, Fashion Malady, Worries Would-Be Redesigners Sick," The Wall Street Journal, May 11, 2009, http://online.wjs.com/article/SB124199135515304615.html, 3 pgs.

*Primary Examiner* — Amy Vanatta
(74) *Attorney, Agent, or Firm* — Brooks Kushman P.C.

(57) ABSTRACT

A medical gown and method of assembling a medical gown for a patient that provides coverage and dignity as well as easy of treatment and examination. The medical gown may include two garment portions. Each garment portion includes a first panel and a second panel which is generally a mirror image of the first panel. Each garment portion is formed by joining the first panel to the second panel along the first and second top edges and joining the first and second outside edges such that an arm opening is formed between the first and second panels. Each garment portion is thereby adapted to be secured to a patient by placing an arm through the arm opening and releasably joining the closure members together under the patient's opposite arm.

17 Claims, 4 Drawing Sheets

U.S. PATENT DOCUMENTS

| | | | | |
|---|---|---|---|---|
| 7,424,750 | B2 | 9/2008 | Kerr | |
| D584,882 | S * | 1/2009 | Trouillot et al. | D2/720 |
| 7,594,279 | B2 | 9/2009 | Roy | |
| 2008/0000006 | A1 * | 1/2008 | Ochoa et al. | 2/114 |
| 2010/0242150 | A1 * | 9/2010 | Trouillot | 2/114 |
| 2010/0313330 | A1 * | 12/2010 | Sampson-Howlett | 2/114 |

* cited by examiner

PATIENT GOWN AND METHOD OF ASSEMBLING ON A PATIENT

TECHNICAL FIELD

The present invention relates to gowns worn by patients in medical facilities, offices or hospitals.

BACKGROUND

Medical technology in treating patients has far outpaced the design of the medical or hospital gowns that patients are forced to wear. While medical treatments have changed vastly over the last century, the gowns have not. For example, where medical procedures have become less invasive, ambulatory treatment and recovery is more common. But where patients are more mobile, the medical gowns have not been improved to offer better access, warmth, comfort, dignity or modesty.

Variations of the current medical gown have been around since at least the 1920's and little has changed about the one-size-fits-all, open-in-the-back style. Not only do traditional medical gowns leave the patients with little dignity as they often leave gaping openings in the front or the back exposing the patient's body for all to see, but they can be difficult for patients to put on as they are required to awkwardly tie the gown in the back. Another disadvantage of traditional medical gowns is that in order for the patient to be examined or treated, the patient must be moved in order undo neck ties and back ties. Where the patient has limited mobility, moving the patient may be painful, or cause a delayed response in testing, examination, diagnosis and treatment.

Attempts to modify medical gowns have been largely unsuccessful. Medical gown designs have become confusing as patients are left wondering what is front or back and perplexed about complex wrap designs. However, medical gowns designs that are modified in order to give patients more dignity and coverage, still must allow the doctors to easily examine the patient or perform medical procedures, without the medical gown getting in the way. Additionally, where a patient can not move, the gown must be easy for medical personnel to put on and take off the patient with little effort.

Doctors, hospitals and patients alike want a medical gown that provides more dignity and comfort for the patient, yet maintains access to the patient for medical treatment.

SUMMARY

An aspect of the present invention is a medical gown for a patient. The medical gown includes a first pair of first panels having a top and bottom generally lateral edge, an inside and outside vertical edge, a generally diagonal edge extending from the inside edge at an incline towards the top edge and a second pair of panels which are a mirror image of the first pair. A first garment portion is formed by a joining one of the first panels to one of the second panels along the top edges to form a first shoulder area and joining along the outside edges. The garment portion having a first arm opening formed between the first and second panels and defined by the shoulder region and the first side. A second garment portion formed by a joining the other one of the first panels to the other one of the second panels along the top edges to form a second shoulder area and joining along the outside edges, the second garment portion having a second arm opening formed between the first and second panels and defined by the shoulder area and the second side. Then, the first and second panels are arranged to form a medical gown so that at least a portion of the first and second garment portions overlap. The first garment portion is thereby secured along the inside edge adjacent the second side and the second garment portion secured along the inside edge adjacent the first side. The medical gown may be symmetric from front to back.

Another aspect of the present invention is a medical gown for a patient where the gown has two garment portions. Each garment portion includes a first panel having a top and bottom lateral edge, an inside and outside vertical edge, a generally diagonal edge extending from the inside edge at an incline towards the top edge and a first releasable closure member located along the inside edge and adjacent the diagonal edge, and a second panel which is generally a mirror image of the first panel. The garment portion is formed by joining the first panel to the second panel along the first and second top edges and joining the first and second outside edges such that an arm opening is formed between the first and second panels and defined by the top edges and outside edges, the garment portion thereby adapted to be secured to a patient by placing an arm through the arm opening and releasably joining the first and second closure members together under the patient's opposite arm.

A further aspect of the present invention is a method of assembling a medical gown. The medical gown may be assembled by first providing a first pair of first panels having a top and bottom lateral edge, an inside and outside vertical edge, and a generally diagonal edge extending from the inside edge at an incline towards the top edge. Next, a second pair of panels is provided where the second pair of panels are a mirror image of the first pair of panels. Then, one of the first panels may be joined to one of the second panels to form a first garment portion having a first arm opening. Next, the other one of the first panels may be joined to the other one of the second panels to form a second garment portion having a second arm opening, the second garment portion separate from the first garment portion. The patient's first arm may be placed through the first arm opening so that the first garment portion covers at least a portion of the patient's body. Then, at least a portion of the inside edges of the first garment portion are secured together under the patient's second arm. The patient's second arm them may be placed through the second arm opening so that the second garment portion overlaps at least a portion of the first garment portion. Finally, at least a portion of the inside edges of the second garment portion are secured together under the patient's first arm. The first and second garment portions may interact to form a reversible medical gown such that the medical gown is symmetric from front to back.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention. The features of various implementing embodiments may be combined to form further embodiments of the invention.

Except in the examples, or where otherwise expressly indicated, all numerical quantities in this description indicating dimensions are to be understood as modified by the word "about" in describing the broadest scope of the invention. Practice within the numerical limits stated is generally preferred. The first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

Figure 1:
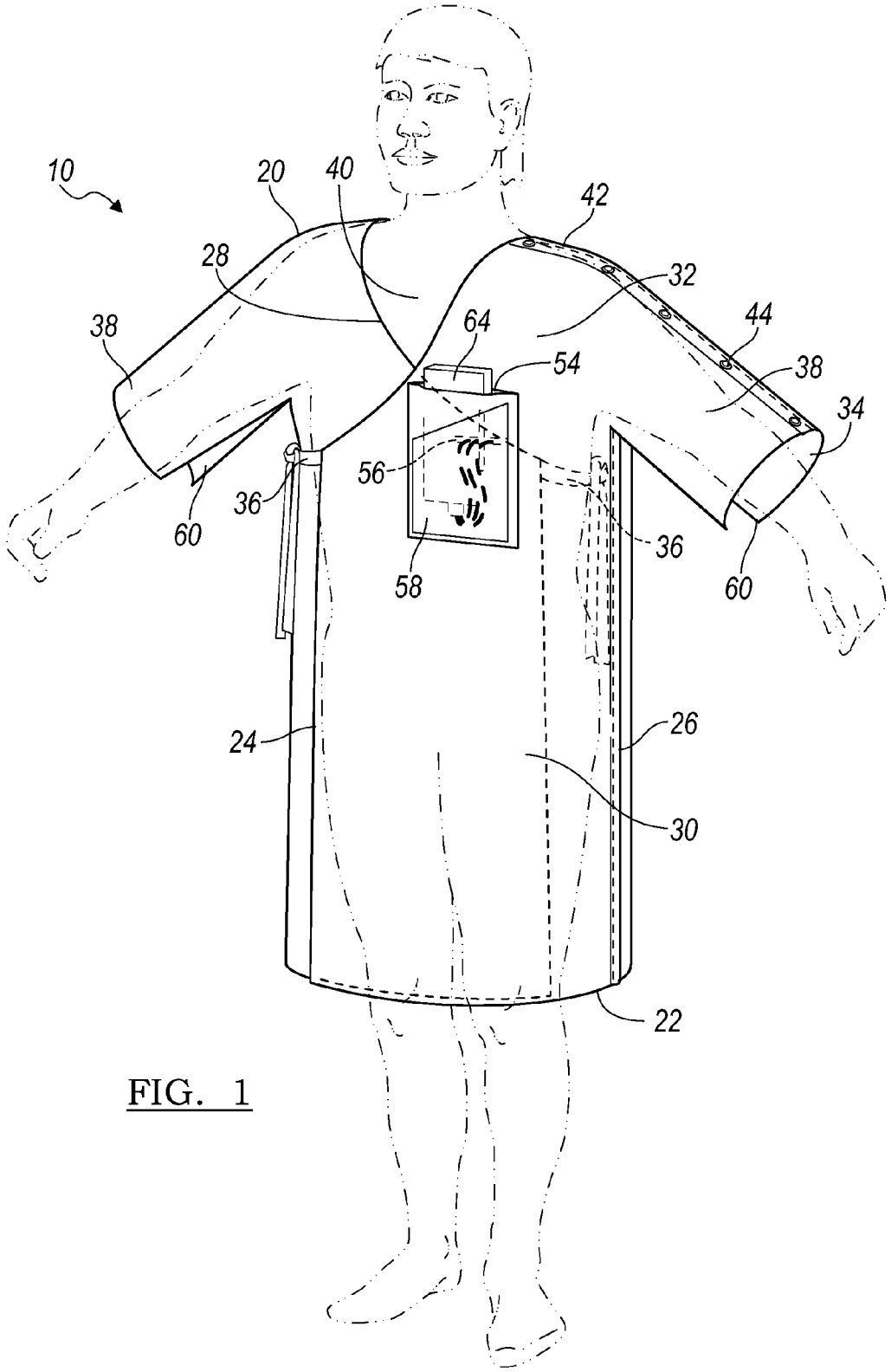
FIG. 1 illustrates a perspective view of a patient wearing a two-piece gown according to an aspect of the present invention.

FIG. 1 illustrates a patient gown 10 according to an aspect of the present invention. The gown 10 is made of two identical garment portions 12 that, when worn together, form a two-piece gown 10.

Figure 2:
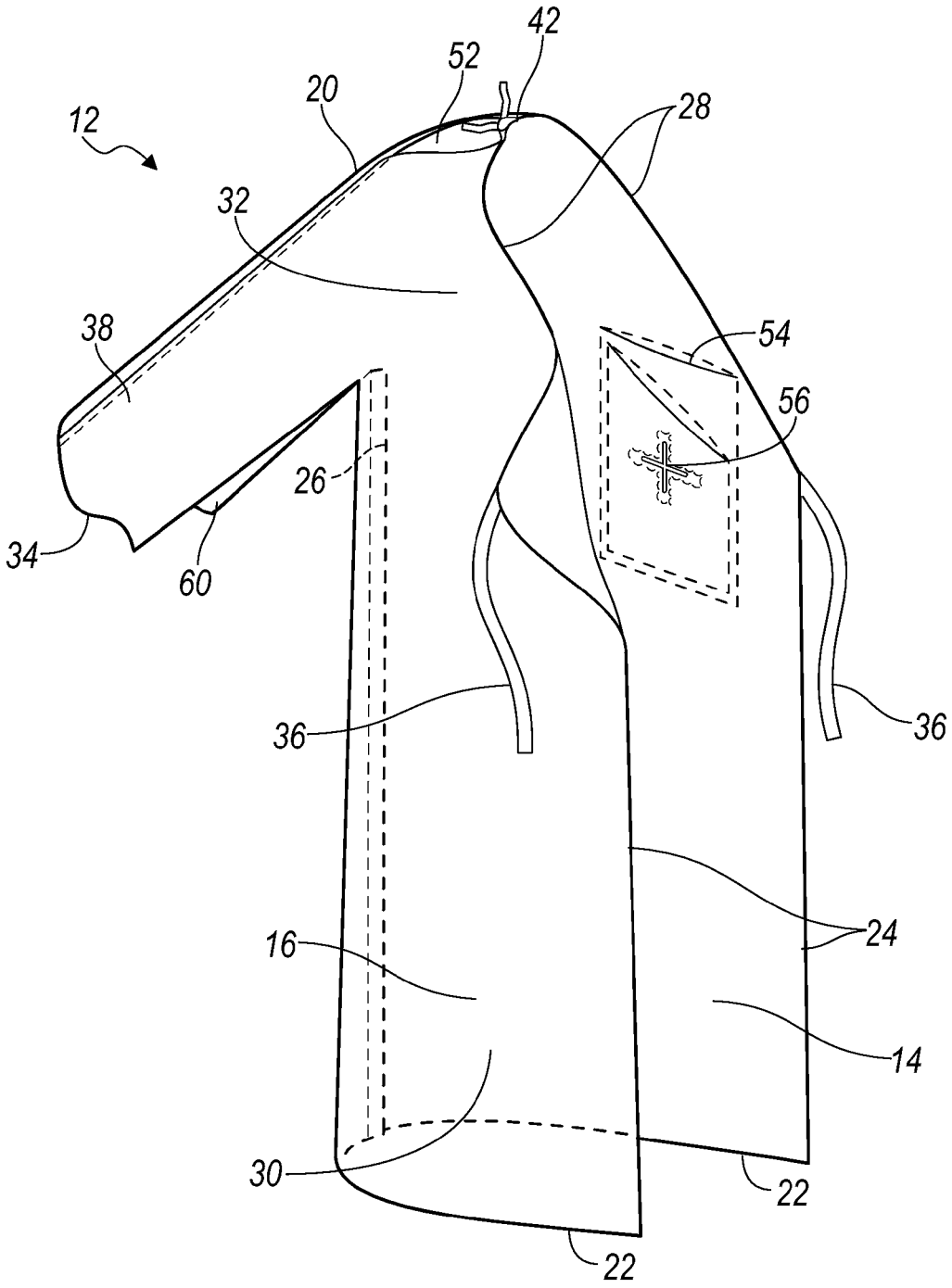
FIG. 2 illustrates a perspective view of one portion of the gown according to an aspect of the present invention.

Each of the garments portions, as illustrated in FIG. 2, includes a front panel 14 and a back panel 16, which are generally a mirror images each other. Each of the front 14 and back panels 16 may have a generally lateral top edge 20 and bottom edge 22, as well as a generally vertical inside edge 24 and outside edge 26. It is also contemplated that the top edge 20 may be angled in order to conform to the contour of the shoulder of a patient. Additionally, the front 14 and back panels 16 may have a generally diagonal edge 28 extending from the inside edge 24 at an incline towards the top edge 20. As such, the front 14 and back panels 16 may have a generally rectangular lower portion 30 and a generally trapezoidal-shaped upper portion 32 where a side the trapezoid is formed by a diagonal edge 28.

The front 14 and back panels 16 may form the garment portion 12 by joining the front panel 14 to the back panel 16 along the panels corresponding top edges 20 and an outside edges 26. An arm opening 34 may be formed between the front 14 and back panels 16 and defined between the top edge 20 and the outside edge 26 which may be joined together. The diagonal neck opening 40 may be formed by the diagonal edge 28 which extends between the top edge 20 and an inside edge 24. Along the inside edge 24, the front 14 and back panels 16 may include an inside closure member 36 where the closure member 36 of the front 14 and the back panel 16 are adapted to be secured together. The closure member 36 may be a strap or pair of straps where the strap from the front 14 and the back panels 16 are adapted to tie together. However, the closure member may be a snap or a button, or any other suitable fastener or suitable closure member. It is also contemplated that the inside edges 24 of the front 14 and back panels 16 are sewn together or permanently fastened.

The garment portion 12 may include an arm opening 34 that is formed between an outside edge 26 and the top edge 20. However, the front 14 and back panels 16 may further include a sleeve portion 38 which extends from the upper portion 32 of the front 14 and back panel 16. Where the front 14 and back panels 16 include a sleeve 38, the top edge 20 may extend along the sleeve portion 38.

The garment portion 12 may be worn by a patient by placing a patient's right arm through the arm hole opening so that the garment portion 12 covers at least a portion of the patient's body, and then securing the inside closure members 36 under the arm of the patient's left arm. To complete the gown 10, the patient may then place a second garment portion 12, identical to the first garment portion 12, on the other side of their body. As such, the patient would place their left arm in a corresponding arm hole and wrap the second garment portion 12 around their body so that it secures underneath the arm of their right arm.

As shown in FIG. 1, when a person is wearing a two-piece gown 10 according to an aspect of the present invention, the closure member of the first garment portion 12 is covered and hidden by the second garment portion 12. By securing the closure members under the patient's arm along the patient's side, it provides a medical gown 10 which allows for more overlap and modesty than previous medical gown designs. Additionally, by securing the closure members along the patient's side or waist and under their arm, it eliminates the need for further closure members along the side, front, or back to prevent the gown 10 from opening and exposing the patient's body.

As further illustrated in FIG. 1, when a person is wearing a two-piece gown 10 according to an aspect of the present invention, the diagonal edge 28 of the two garment portions 12 may overlap or intersect to make a V-shaped neck opening 40. The V-shaped neck opening 40 may allow for easier examination of the patient's chest without removing the gown 10. Additionally, the V-shaped neck may allow the garment portions 12 to be easily slid over the patient's shoulder for better access to the patient's upper body, without having to remove the gown 10, or undo any of the inside closure members 36.

To form the garment portions 12, the front 14 and back panels 16 may be joined along the outside edge 26. The front and back garment portions 12 may be joined along the outside edges 26 with a seam, or any other suitable technique for joining the fabric of the front 14 and back panels 16.

Figure 3:
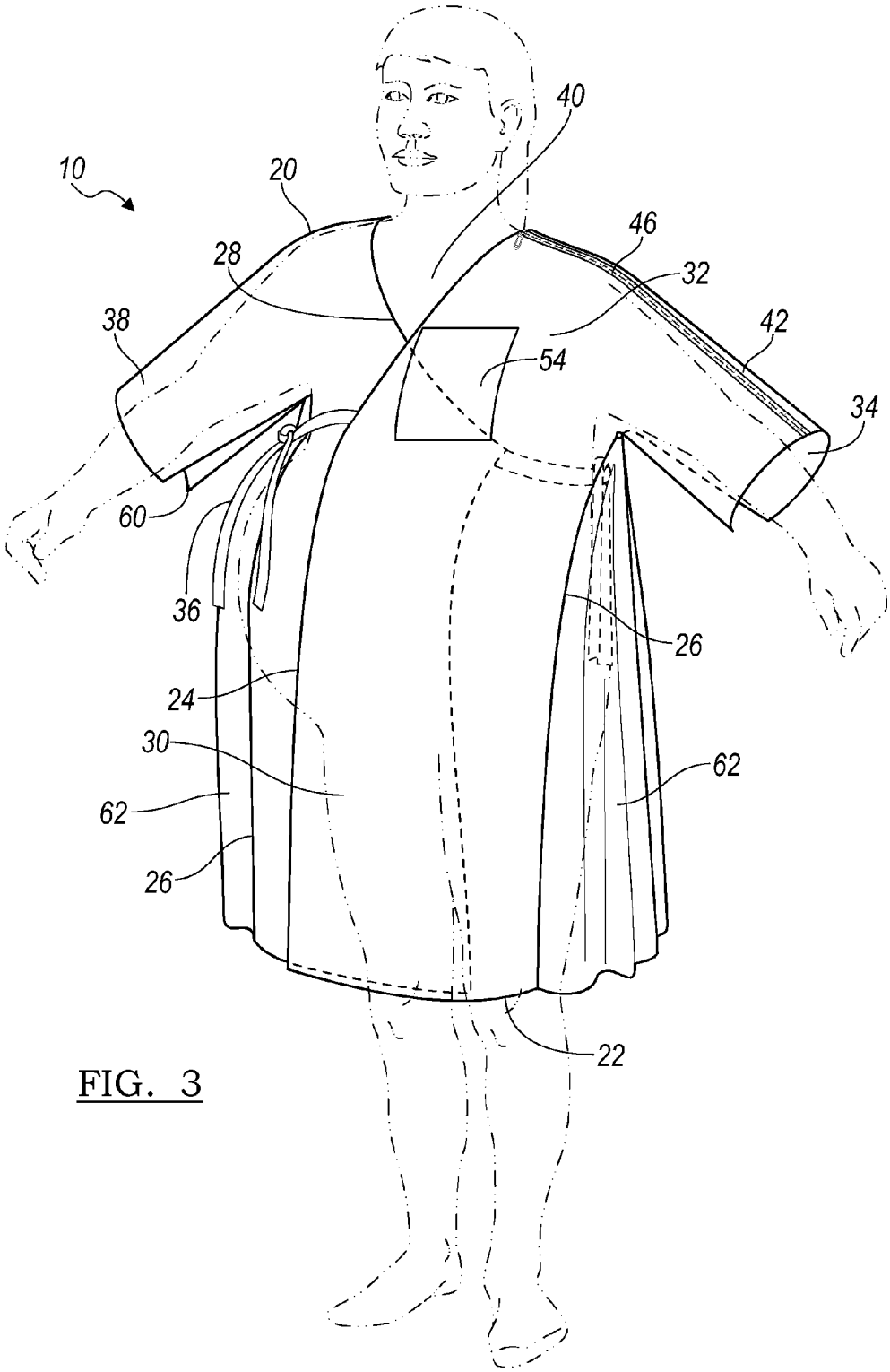
FIG. 3 illustrates a perspective view of a gown according to an aspect of the present invention.

Likewise, the top edges 20 of the front 14 and back panels 16 may also be joined with a seam to form a shoulder region. However, it is also contemplated that the top edge 20 of the front 14 and back panel 16 may be joined with releasable fastening members such as snaps 44, as shown in FIG. 1. FIG. 3 further illustrates a top edge 20 joined by a zipper 46 to form the shoulder region of the garment portion. The top edges 20 may be further joined by any number of releasable fasteners, further including but not limited to buttons, hook-and-loop fasteners, ties or any other suitable fastener. Further, the front 14 and back panels 16 may be a single piece where they are joined by a fold.

By having releasable fastening members such as snaps or zippers along the top edge 20, it allows the front 14 and back panel 16 of the gown 10 to be opened along the top edge 20 so that a patient can be examined without removing the entire gown 10. The snap or fastener shoulder may expose the patient's entire shoulder below the elbow.

Another advantage of having a releasable fastener member along the top edge 20 is that the gown 10 can be removed or put on a patient while the patient is lying on a hospital bed without that patient getting up. The garment portion 12 could be removed from the patient while the patient is lying down or unable to move whereby the inside closure member 36 is unfastened, the top fastening members 42 are opened all along the top edge 20, and the front panel 14 is pulled over the patient and off of their arm. In this way, the patient's body is exposed without the patient having to stand up or move their arms to get out of the gown 10. This may be advantageous, for example, during an examination where the patient cannot move without pain, or during a surgery where the patient is not awake. Then, after the procedure, the gown 10 can be reattached to the patient without the patient having to get up whereby the fastening members along the top edge 20 are reclosed and the inside closure is refastened in order to secure the front 14 and back panels 16 to the patient.

Where the top edge 20 of the front 14 and back panels 16 is joined as a seam, the top edge 20 may have an extendable neck opening to allow the gown 10 to be pulled down over the shoulder of the patient to allow for easy examination of the upper torso and chest area. As illustrated in FIG. 2, the top edge 20 may include a slit 52 opening where the slit 52 opens from the diagonal edge 28 but does not extend the entire length of the sleeve 38. The slit 52 may have a top fastener 42, such as a tie, at the opening adjacent the diagonal edge 28 in order to keep the slit 52 closed but the slit 52 may further enable the gown 10 to be pulled down over the shoulder to the elbow of a patient when unfastened.

Figure 4:
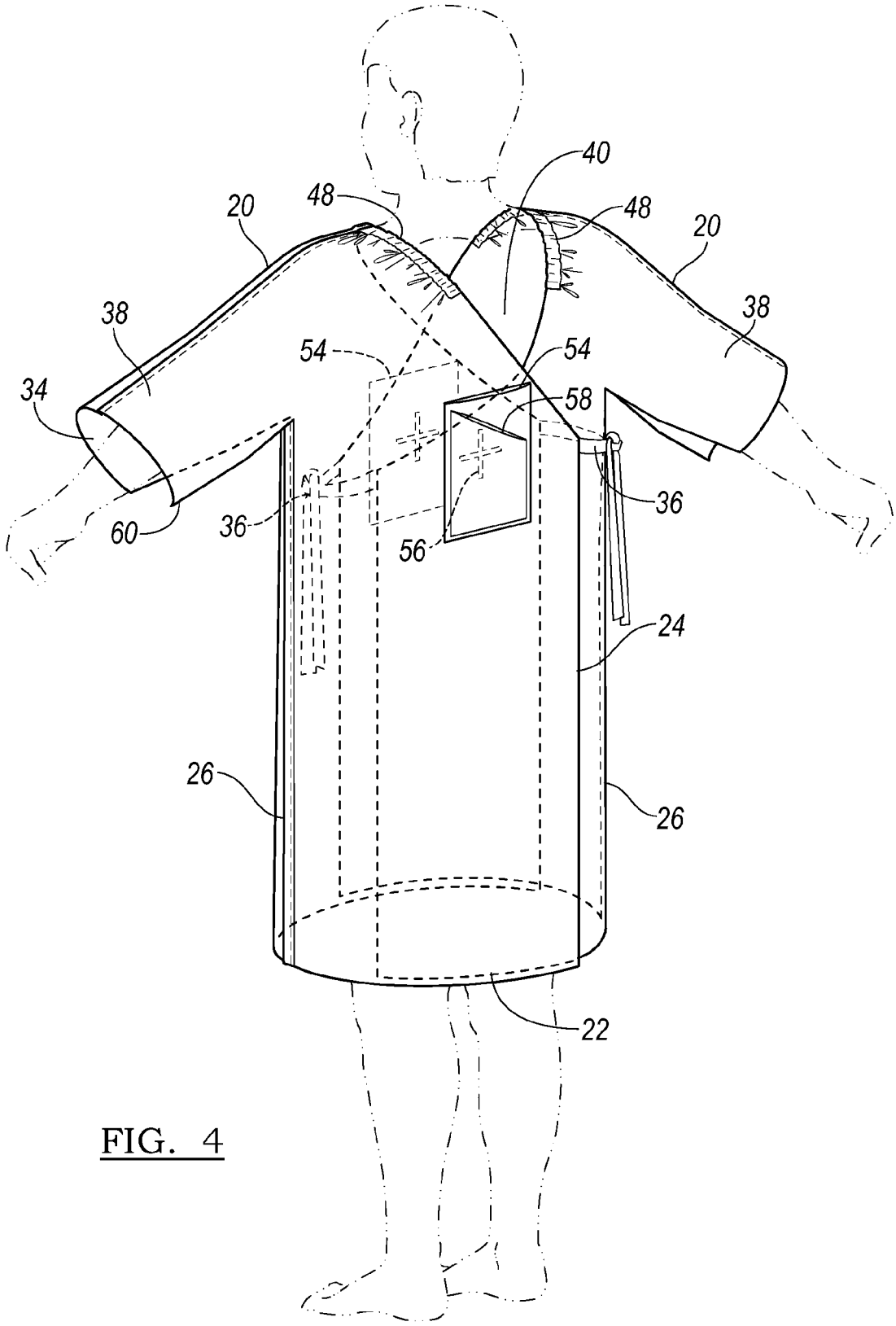
FIG. 4 illustrates a rear perspective view of a two-piece gown according to an aspect of the present invention.

It is further contemplated that have other extendable neck opening features to allow the garment portions 12 to be easily pulled down over the patient's shoulder. As illustrated in FIG. 4, the garment portions 12 may have an area of elastic 48 along the diagonal edges 28 of the front 14 and back panels 16. The elastic 48 may allow the garment to stretch and easily pull over the shoulder of the patient without removing the gown 10. The elastic pulldown shoulder may be pulled down beyond the elbow.

In another embodiment of the present invention, the extendable neck opening may have a shoulder portion with a wrap shoulder along the top edge 20 of the front and back garment portions 12. The wrap shoulder may include an additional piece of fabric joining the front 14 to the back panels 16 so that the top edge 20 can be easily pulled down over the shoulder of the patient. The wrap shoulder may have an extended overlay, sewn interlocking into the shoulder of the garment allowing it to open down to the side of the body.

The gown 10 may further include a pocket 54 on the front panel 14. The pocket 54 may be adapted to hold a variety of items. For example, the pocket 54 may be configured to hold medical devices, store fluids which are to be administered intravenously, or hold medications. The gown 10 may also include an additional pocket 58 which may be adapted to hold other medical equipment or hold personal items.

The pocket 54 may be located adjacent the diagonal edge 28 of the front panel 14. In one aspect of the present invention, it is further contemplated that when the gown 10 is worn by the patient, the pocket 54 is located generally at a center region of the two-piece gown 10 or generally located at the at the center of the patient's body. In this configuration, when the pocket 54 is holding a medical device or other item, the weight of the pocket 54 contents do not pull or shift the gown 10 to one side in order to keep the patient from being exposed. However, the pocket 54 may be located at any suitable area on the garment portions 12. The additional pocket 58 may be located on top of the device pocket 54. In this case, the additional pocket may have a diagonal opening to allow easy access to both the pockets. However, the additional pocket 58 may be located at any suitable area on the garment portions and may be any suitable shape or size.

As illustrated in FIG. 4 which shows the back of a patient wearing a gown 10 according to an aspect of the present invention, while the pocket 54 may be located on the front panel 14 of one of the garment portions 12, since the front 14 and back panels 16 are symmetric, and the first and second garment portions 12 are also symmetric, the pocket 54 of the corresponding garment portion 12 may be located on the back of the patient. Where the patient is wearing two garment portions 12 to form a gown 10 according to an embodiment of the present invention, a pocket 54 may be located on both the front and the back of the gown 10 so that the two-piece gown 10 may include at least two pockets 54. The V-shaped neck opening 40 allows easy access to the pocket 54 on the front or the back of the gown 10, even when the pocket 54 may be overlapped by the other garment portion 12.

As shown in FIG. 2, the front panel 14 may have a device opening 56. The device opening 56 may be covered by the pocket 54 so that the device opening 56 may be on the inside surface of the pocket 54. The device opening 56 would allow wires or tubes, which are connected to a medical device which is stored in the pocket 54, to be connected to the patient. Since the device opening 56 is hidden inside the pocket 54, the opening does not expose the patient and allows the wires to be easily connected or routed to the patient.

The device opening 56 may be an aperture formed with a die-cut and reinforced with stitching. Alternatively, the device opening 56 may be formed with intersecting buttonholes that form a cross or star-shaped opening so that the corners may flap open to allow for a larger opening but where the corners may remain closed and together when not in use. It is further contemplated that the device opening 56 may be one elongated opening or may be any shape suitable to accommodate the wires and tubes of a medical device.

To further allow easy examination of a patient while maintaining coverage and modesty, the gown 10 may include an underarm opening 60. The underarm opening 60 may be a slit 52 that extends from a distal end of the sleeve portion 38 and extend in as far as the outer edge. It is contemplated that the underarm opening 60 may be 24 centimeters but may vary from 19 cm to 30 cm, depending on the size of the garment portion 12 or the length of the sleeve portion 38.

The garment portions 12 may be formed in a variety of sizes in order to accommodate different sized patients. In an average sized garment portion, the front 14 and back panels 16 may be 49 cm wide but may vary from 44 cm to 54.5 cm to accommodate the larger and smaller sized gowns. The diagonal edge 28 may be 42.5 cm long but may also vary from 38 cm to 47.5 cm. Where the gown 10 includes a sleeve 38, the top edge 20 may be 63 cm long but the top edge 20 may vary from 59 cm to 68.5 cm depending on the length of sleeve 38 or configuration of arm opening 34. The arm opening 34 may be 47.5 cm in diameter but may vary from 24 cm to 53.5. The outside edge 26 may be 79.5 cm long but may vary from 74 cm to 85.5 cm, depending on the size of the gown, or the desired length and coverage of the gown. It is also contemplated that the gown may be configured as a shirt where the outside edge 26 may be much shorter. The diameter around the bottom edge 22 of the gown is 95.5 cm, but may vary from 90 cm to 100 cm.

It is understood that the dimensions listed above are exemplary to illustrate a variety of sized gowns. The dimensions may be further varied and are no way limiting on the invention. As the gowns are designed to be manufactured in a variety of sizes, the garment panels can also be made of any color or coordinated by color for each size. In this way, the first and second garment portions 12 of the same size can be easily matched to each other.

FIG. 3 illustrates an additional feature of the two-piece gown 10 which may further accommodate a range of sizes or body types of patients. The front 14 and back panel 16 of the gown 10 may further include an insert 62 located between the outside edges 26 of the front 14 and back panels 16. The pair of inserts 62 may run from the arm opening 34 to the bottom edge 22 of the gown 10 and the width of the insert 62 may increase as it goes from the arm opening 34 to the bottom edge 22 of the gown 10. The insert 62 allows a greater size variation where standard sized front 14 and back panels 16 are used. It is contemplated that the diameter of the bottom edge 22 of a gown with inserts may be 110 cm, but may vary. The insert 62 may be particularly helpful on patients such as pregnant women or overweight patients. In the case of a patient who is a pregnant woman, as pictured in FIG. 3, the gown 10 with side inserts 62 may allow the upper portion 32 of the gown 10 to fit as a traditional gown without inserts 62 but accommodate extra room in the lower portion 30 where the patient needs extra room. This ensures that the amounts of overlap and modesty features of the gown 10 are maintained.

FIG. 4 illustrates the two-piece gown 10 on a patient shown from the back. As noted previously and illustrated in FIG. 4, the gown 10 is symmetric. By having two garment portions 12 that are identical, or mirror images of each other, the gown 10 is symmetric from front to back, or from left to right.

The diagonal edges 28 create a V-shaped neckline along the front and the back of the patient. Further, the gown 10 may have a device pocket 54 located on the front and the back of the gown 10. By having a medical gown 10 that is symmetric from front to back and left to right, it eliminates patient confusion about which way to secure a gown 10 when putting it on. The amount of overlap of the gown 10 and the garment portions 12 is the same in the front and back preventing the patient from showing a portion of their body inadvertently, irrespective of which way the gown 10 is worn.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A medical gown for a patient, the gown having two garment portions, each garment portion comprising:

a first panel having a top and bottom generally lateral edge, an inside and outside generally vertical edge, a generally diagonal edge extending from the inside edge at an incline towards the top edge and a first releasable closure member located along the inside edge and adjacent the diagonal edge;

a second panel which is generally a mirror image of the first panel, the second panel having a top and bottom generally lateral edge, an inside and outside generally vertical edge, a generally diagonal edge extending from the inside edge at an incline towards the top edge and a second releasable closure member located along the inside edge adjacent the diagonal edge;

an elastic portion extending along at least a portion of the diagonal edges of the first and second panels; and wherein the garment portion is formed by joining the first panel to the second panel along the first and second top edges and joining the first and second outside edges such that an arm opening is formed between the first and second panels and defined by the top edges and outside edges, the garment portion thereby adapted to be secured to a patient by placing an arm through the arm opening and releasably joining the first and second closure members together under the patient's opposite arm.

2. The garment of claim 1 wherein the first and second panels are joined along at least a portion of the top edge with a releasable fastener.

3. The garment portion of claim 1 wherein the first panel further includes at least one pocket adapted for holding a device.

4. The garment portion of claim 1 wherein the first panel includes a device opening formed in a center portion of the panel.

5. The garment portion of claim 4 wherein the device opening is a die-cut reinforced aperture.

6. The garment portion of claim 4 wherein the device opening is formed with intersecting button-holes.

7. The garment portion of claim 4 wherein the first panel further includes at least one pocket located adjacent the diagonal edge, the pocket disposed over and covering the device opening.

8. The medical gown of claim 1 wherein the diagonal edges of the front and back panels do not include a fastener.

9. A medical gown for a patient, the medical gown comprising:

a first pair of first panels having a top and bottom generally lateral edge, an inside and outside generally vertical edge, a generally diagonal edge extending from the inside edge at an incline towards the top edge;

a second pair of second panels which are a mirror image of the first pair of panels, the second pair of panels having a corresponding top and bottom generally lateral edge, an inside and outside generally vertical edge, a generally diagonal edge extending from the inside edge at an incline towards the top edge;

an elastic portion extending along at least a portion of each of the diagonal edges of the first and second panels;

a first garment portion formed by a joining one of the first panels to one of the second panels along the top edges to form a first shoulder area and joined along the outside edges to form a first side, the first garment portion having a first arm opening formed between the first and second panels and defined by the shoulder area and the first side;

a second garment portion formed by a joining the other one of the first panels to the other one of the second panels along the top edges to form a second shoulder area and joined along the outside edges to form a second side, the second garment portion having a second arm opening formed between the first and second panels and defined by the shoulder area and the second side;

a first closure member included on the first garment for releasably securing the first garment portion to the patient, the first closure member located along the inside edge and adjacent the diagonal edge; and a second closure member included on the second garment for releasably for securing the second garment portion to the patient, the second closure member located along the inside edge and adjacent the diagonal edge, and wherein the first closure member is a first pair of straps extending from the inside edge of the first garment portion, the first straps being adapted to be tied under the patient's opposite arm and the second closure member is a second pair of straps extending from the inside edge of the second garment portion, the second straps adapted to be tied secured under the patient's other arm, the second garment portion thereby covering the first closure member, and wherein the first and second panels arranged to form a medical gown so that at least a portion of the first and second garment portions overlap, the first garment portion thereby secured along the inside edge adjacent the second side and the second garment portion secured along the inside edge adjacent the first side, the medical gown thereby being symmetric from front to back.

10. The garment portion of claim 9 wherein the gown further includes an extendable neck opening portion which is adapted to allow the gown to be pulled over the shoulder of the patient.

11. The medical gown of claim 9 wherein the first garment portion is separate from the second garment portion.

12. The medical gown of claim 9 further including a pair of inserts wherein one of the inserts is located along the first side and joined between the outside edges of the first garment portion, and the other of the inserts located along the second side and is joined between the outside edges of the second garment portion.

13. The medical gown of claim 9 wherein each of the first panels further includes at least one pocket adapted for holding a device, the pocket thereby disposed on the front and the back of the medical gown.

14. The medical gown of claim 9 wherein at least one of the first panels includes a device opening, the device opening covered by a pocket disposed over the device opening wherein the pocket is disposed adjacent the diagonal edge of at least one of the first panels.

15. The medical gown of claim 14 wherein the device opening is a die-cut reinforced aperture.

16. The medical gown of claim 14 wherein the device opening is formed with intersecting button-holes.

17. The medical gown of claim 9 wherein the diagonal edges of the first and second garment portions are not fastened together.

* * * * *